US006116958A

United States Patent [19]

Reichle

[11] Patent Number: 6,116,958

[45] Date of Patent: Sep. 12, 2000

[54] ELECTRICAL ADAPTED

[75] Inventor: Hans Reichle, Wetzikon, Switzerland

[73] Assignee: Reichle + De Massari AG Elekro-Ingenieure, Wetzikon, Switzerland

[21] Appl. No.: 08/860,439

[22] PCT Filed: Oct. 24, 1996

[86] PCT No.: PCT/CH96/00376

§ 371 Date: Aug. 26, 1997

§ 102(e) Date: Aug. 26, 1997

[87] PCT Pub. No.: WO97/15968

PCT Pub. Date: May 1, 1997

[30] Foreign Application Priority Data

Oct. 26, 1995 [CH] Switzerland ..... 3025/95

[51] Int. Cl.[7] ..... H01R 25/00

[52] U.S. Cl. ..... 439/640; 439/21

[58] Field of Search ..... 439/640, 21, 31, 439/173, 446, 638, 676; 379/434, 437, 438

[56] References Cited

U.S. PATENT DOCUMENTS

| | | | |
|---|---|---|---|
| 3,530,424 | 9/1970 | Gregory | 439/355 |
| 4,295,702 | 10/1981 | Snyder . | |
| 4,673,228 | 6/1987 | Ditzig | 439/21 |
| 4,738,635 | 4/1988 | Harrington et al. | 439/452 |
| 4,743,999 | 5/1988 | Hames | 439/173 |
| 4,850,880 | 7/1989 | Zayat, Jr. et al. | 439/11 |
| 5,082,448 | 1/1992 | Kang | 439/21 |
| 5,087,208 | 2/1992 | Chang | 439/676 |
| 5,092,793 | 3/1992 | Stephan | 439/446 |
| 5,466,165 | 11/1995 | Boesel et al. | 439/142 |
| 5,484,303 | 1/1996 | Cheng | 439/345 |
| 5,658,152 | 8/1997 | Selker | 439/31 |

FOREIGN PATENT DOCUMENTS

9017585 U 5/1991 Germany .

*Primary Examiner*—Brian Sircus
*Assistant Examiner*—Michael C. Zarroli
*Attorney, Agent, or Firm*—Venable; George H. Spencer; Allen Wood

[57] ABSTRACT

The adapter is provided with plugging and/or socket connector especially for interfaces at electronic devices. Housing components which hold the plugging and/or socket connectors are joined by an articulated joint. The plugging and/or socket connectors are connected by a band-shaped flexible printed conductor foil (20) with a number of parallel printed conductors, with printed conductor sections of the printed conductor foil providing direct plugged contacts of the plugging and/or socket connection.

8 Claims, 3 Drawing Sheets

Fig.1
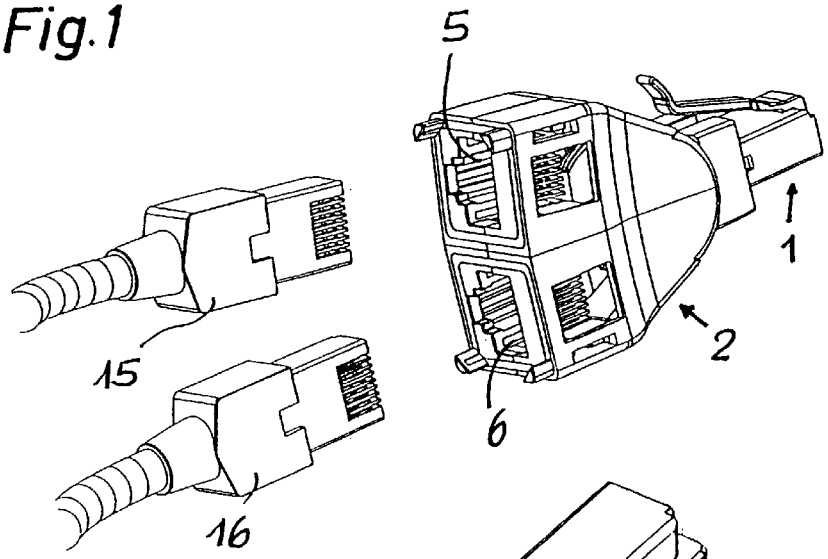
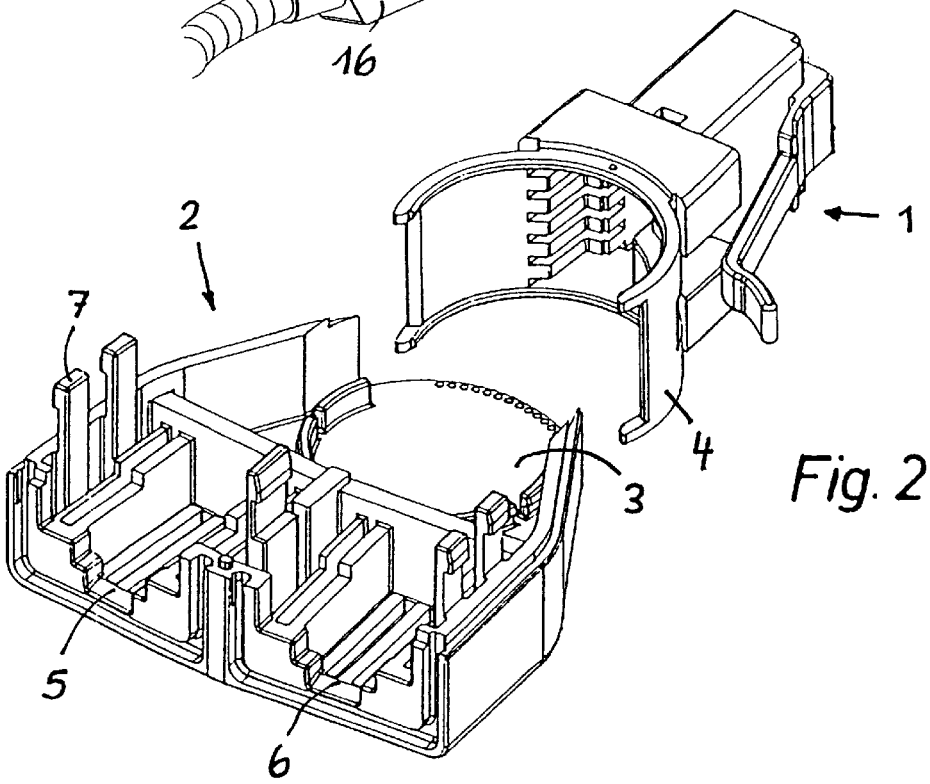
Fig. 2
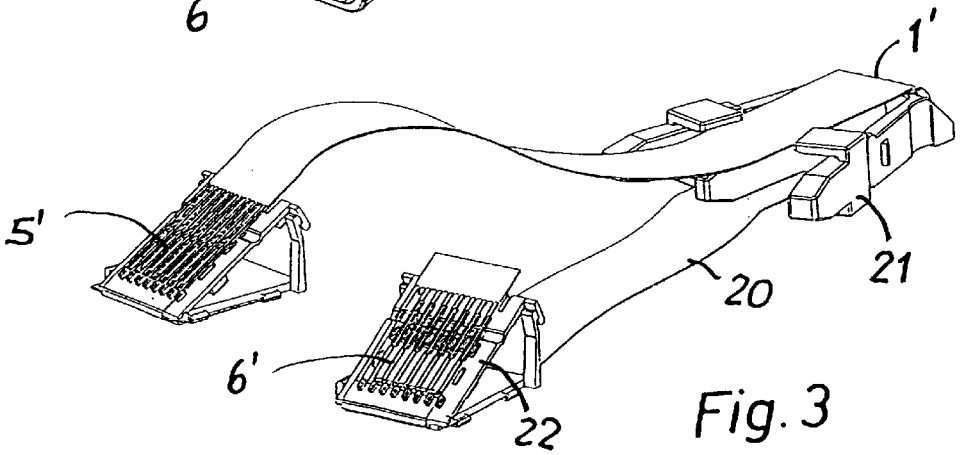
Fig. 3

Fig. 4
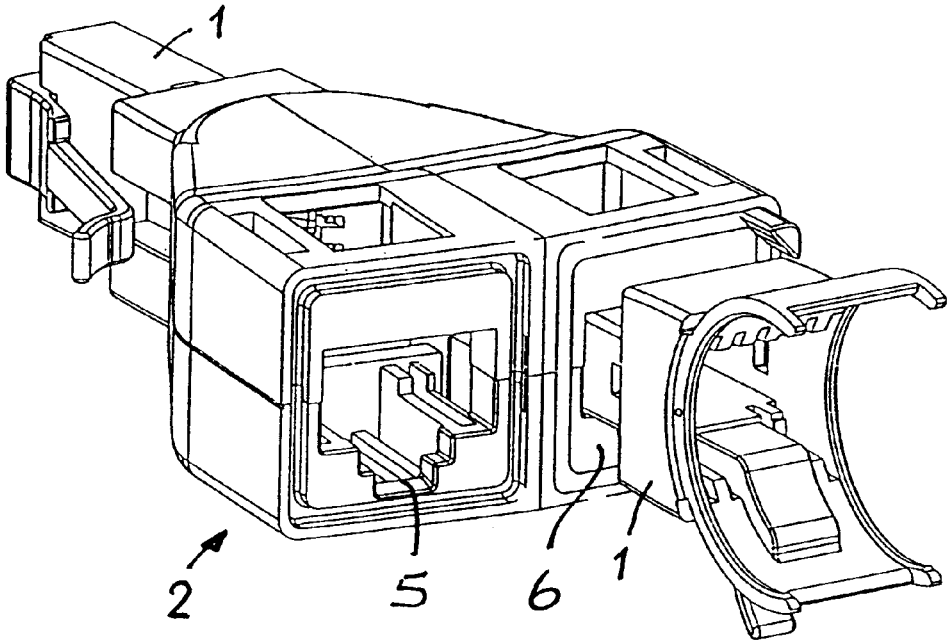
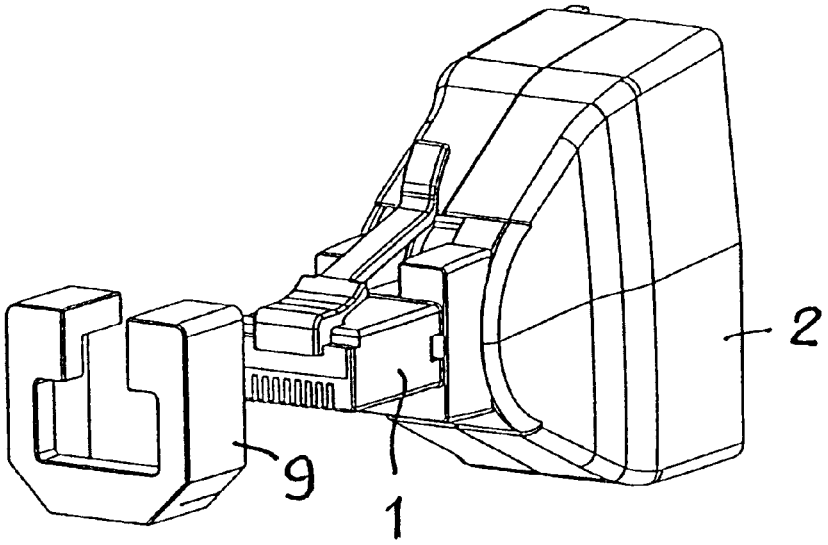
Fig. 5

ELECTRICAL ADAPTED

BACKGROUND OF THE INVENTION

The present invention relates to an electrical adapter with plugging and/or socket connection means, especially for interfaces at electronic devices.

This patent is the 371, National stage of PCT/CH 96/00376. Multiple connections via adapters, often connected in sequence, are required in many areas of telecommunications and data transfer technology, though they can present problems and obstacles relating to volume. Especially at interfaces of electronic devices such as computers, multiple connections often require the use of at least two adapters in sequence which then creates a serious obstacle to positioning of the device. Furthermore, connecting various transfer systems is not always possible with conventional adapters.

SUMMARY OF THE INVENTION

Therefore, the purpose of the present invention is to create an adapter of the type described above which does not project as far from the device and which can be connected in sequence without presenting an obstacle to positioning.

This purpose is fulfilled according to the invention in that the shell sections of the plugging and/or socket connection means are joined in an at least partially articulated connection.

For this purpose, one of the shell sections can consist of two half shells which can be snapped together, which terminate in a pan-shaped joint part and which surround a capsule-shaped joint part on the other shell section in such a way that it can swivel, or each of the flexibly connected shell sections of the plugging and/or socket connection means can terminate in laterally reversed capsule-shaped joint parts which can be snapped together near the joint.

As explained in an application of the same date (Swiss patent application Ser. No. 03024, filed Oct. 26, 1995, corresponding to U.S. patent application Ser. No. 08/860, 438, filed in the U.S. national stage on Jun. 26, 1997) from the same applicant, through-connections of the contacts by means of a band-shaped flexible printed conductor foil with a number of parallel printed conductors can be through-connected with such adapters provided with a number of plugging and/or socket connection means, whereby the at least partially electrically separable contacts are through-connected via a number of at least partially parallel printed conductors on the printed conductor foil and whereby printed conductor sections in the plug areas of modular plugging and/or socket connection means create direct plugged contacts. In this case, keeping the printed conductors separate, at least in the plug areas, by means of plastic ribs and subjecting the printed conductor sections which create the plugged contacts to at least some extent to the effects of springs which create contact pressure is preferable. Furthermore, the printed conductor foil can be folded near its center or continuously and inserted into and locked in the connector shell section by means of clamp-like components for the through-connections, whereby the front of the clamp-like component forms the plug-side contact surface for the exposed printed conductors at that point and whereby each of the free ends of the printed conductor foil are supported in a socket and form the contact area of both sockets with the exposed printed conductors.

As a result of these measures, one or more parts of the adapters can be swiveled away from the direction in which it is plugged, thereby considerably reducing the size of the projection at the interface. Furthermore, an additional swiveling adapter can be attached to create an additional swiveling plane.

Using a printed conductor foil for through-connections of the contacts produces results in not only a great deal of freedom for swiveling such adapters; spaced contacts can be connected without crossings or soldering, and a large number of variations is possible.

BRIEF DESCRIPTION OF THE DRAWINGS

Various embodiments of the object of the invention are described in detail on the basis of the drawings, which show the following:

FIG. 1 is a diagram of a swiveling adapter according to the invention for connecting two plugs;

FIGS. 2 and 3 are diagrams a diagram of the swiveling adapter as shown in FIG. 1 when open;

FIGS. 4 and 5 are diagrams a diagram of an embodiment of the swiveling adapter from a different perspective;

DESCRIPTION OF THE PREFERRED EMBODIMENTS

The design of a first embodiment of the swiveling adapter according to the invention as shown in FIG. 1, in this case with a plug 1 on the one side and two sockets 5,6 on the other side for receiving plugs 15,16, is shown in FIGS. 2 and 3.

An important aspect of this embodiment is that the connection of shell sections 1 and 2 is articulated to at least some extent.

Figure 6:
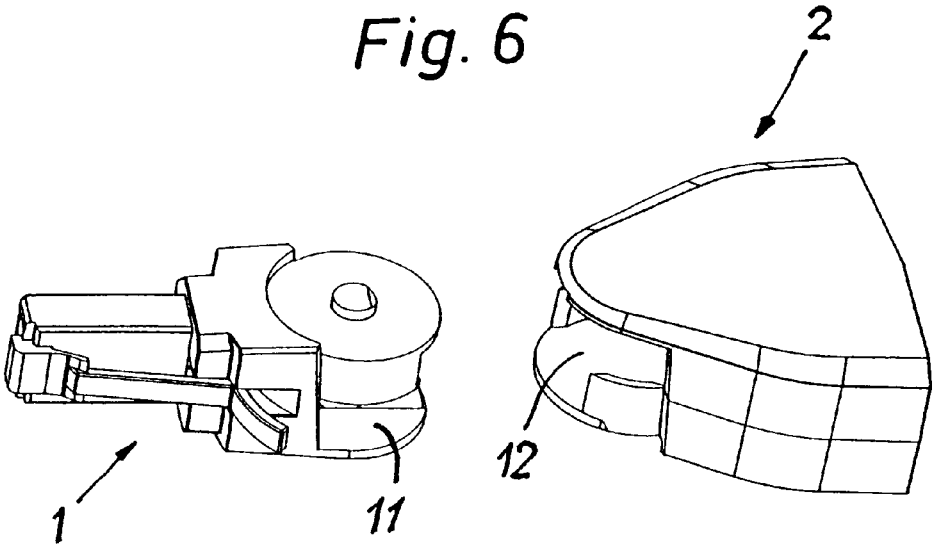
FIG. 6 is a diagram of an embodiment of a swiveling adapter when open.
Figure 7:
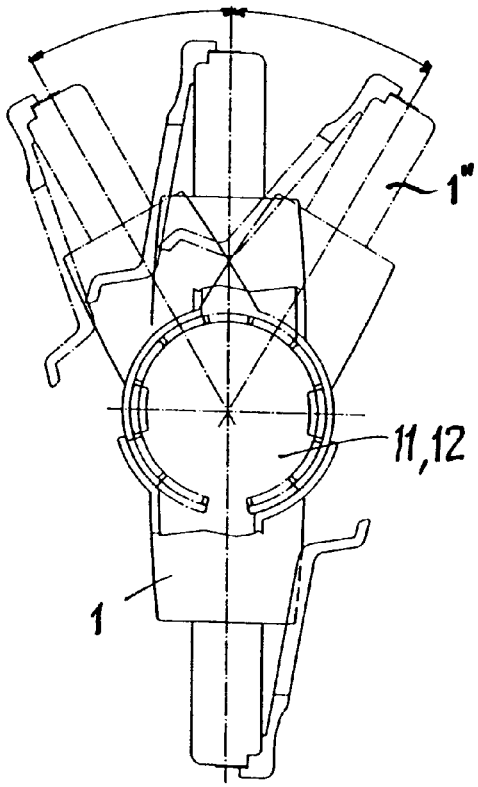
FIGS. 7 and 8 are overhead views an overhead view of an additional embodiment of swiveling adapters.
Figure 8:
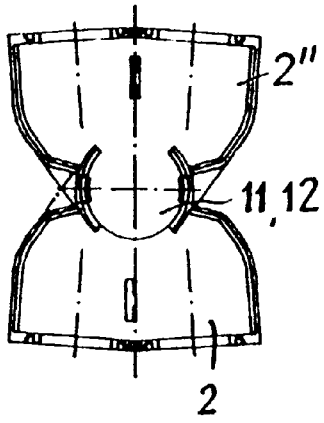

In this case example, the plugging and/or socket connection means can be plug-socket 1,2 as shown in figures 1,2,4,5 and 6, or plug-plug 1,1" as shown in FIG. 7, or socket-socket 2,2" as shown in FIG. 8.

In the first embodiment as shown in FIG. 2, at least the socket-shell means 2 comprises two half shells (only one is shown) which can be snapped together by means of catches 7 which terminate in a pan-shaped joint part 3 on their plug side and which surround a capsule-shaped joint part 4 at the plug part-shell means 1 in such a way that they can swivel.

The socket/housing parts 2 surround two preferably symmetrically adjacent sockets 5, whereby an asymmetrical arrangement is of course also possible.

With the adapter shown, which has a number of through-connected contacts between the plug part 1 and the sockets 5,6, the contacts 1',5' and 6' are through-connected by means of a band-shaped flexible printed conductor foil 20 with a number of printed conductors (FIG. 3), whereby the contacts, at least some of which are partially electrically separable, are through-connected by means of a number of at least partially parallel printed conductors on the printed conductor foil and whereby printed conductor sections in the plug areas of the modular plugging and/or socket connection means create direct plugged contacts. Sufficient insulation resistance between adjacent printed conductors can be ensured by separating the exposed printed conductors by means of plastic ribs (not shown).

Such a printed conductor foil can connect an extremely wide variety of contact areas by being folded and/or twisted appropriately. In this case, the printed conductor foil 20 is folded at its center and inserted into and locked in the connector shell part 1 by means of a clamp-like component 21, whereby the front of the clamp-like component 21 forms the plug-side contact surface for the exposed printed conductors and whereby each of the free ends of the printed conductor foil 20 are supported in a socket and form the contact area 5',6' of both sockets 5,6 with the exposed printed conductors. These free ends of the printed conductor foil are preferably supported by bridges 22, whereby the exposed printed conductors are at least partially subjected to the affects of the springs which create contact pressure for the purpose of creating sufficient contact pressure on the relatively small contact surfaces (not shown).

The measures described above make it possible to swivel the part of the plug or adapter with the socket or sockets out of the plugging direction of the plug or adapter and thereby considerably decrease the size of the projection at a device's interface. In addition, the use of a printed conductor foil for through connecting the contacts not only provides a great deal of freedom of movement for swiveling such adapters, the spaced contacts can also be connected without crossings or soldering, and a large number of connection variations are also possible.

An additional swiveling plane can be created by connecting an additional swiveling adapter as shown in FIG. 4, which is suggested by its plug part 1.

As shown in FIG. 5, the plug part 1 of the swiveling adapter can be coded by means of an attachable sleeve drawing 9.

With an embodiment as shown in FIG. 6, the shell sections 1,2 of the plugging and/or socket connection means which are joined in an articulated connection can each terminate in the articulated area in laterally reversed, capsule-shaped joint parts 11,12 which can be snapped together.

This permits a simple allocation of plugging and/or socket connection means on the adapter as desired. Furthermore, this adapter can be added to by connecting Freenet, etc.

What is claimed is:

1. An electrical adapter, comprising:

a first connector;

a first housing section for holding the first connector, the first housing section terminating in a pan-shaped joint portion, the first housing section including two half shells that are snapped together;

a second connector;

a second housing section for holding the second connector, the second housing section terminating in a capsule-shaped joint portion that is snapped together with the pan-shaped joint portion to interlock the first and second housing sections with an articulated joint; and means for electrically connecting the first and second connectors, wherein the means for electrically connecting comprises a band-shaped flexible printed conductor foil with a number of parallel printed conductors, and wherein the first and second connectors have direct plugged contacts that are formed by sections of the printed conductors.

2. An adapter as claimed in claim 1, further comprising a third connector that is held by the first housing section and that is disposed symmetrically adjacent the first connector.

3. An adapter as claimed in claim 1, wherein the first and second connectors have plug areas, and wherein the first and second connectors comprise plastic ribs, the printed conductors being held apart by the plastic ribs in the plug areas.

4. An adapter as claimed in claim 1, wherein the first connector comprises spring means for exerting contact pressure on the section of the printed conductor which forms the plugged contacts of the first connector.

5. An adapter as claimed in claim 1, wherein the printed conductor foil has free ends, wherein the sections of the printed conductors include a first section disposed at one of the free ends, a second section disposed between the free ends, and a third section disposed at the other of the free ends, wherein the direct plugged contacts of the first connector are formed by the first section of the printed conductors, wherein the second connector comprises a clamping component about which the printed conductor foil is folded, the printed conductor foil being inserted into and locked in the adapter by the clamping component, the clamping component having a front end which forms a plug-side contact surface for the second section of the printed conductors, and wherein the adapter further comprises a third connector that is held by the first housing section, the third connector including direct plugged contacts that are formed by the third section of printed conductors.

6. An adapter as claimed in claim 1, wherein at least one of the first and second connectors is a plugging connector.

7. An adapter as claimed in claim 1, wherein at least one of the first and second connectors is a socket connector.

8. An adapter as claimed in claim 1, wherein the first and second connectors are disposed on opposite sides of the articulated joint.

* * * * *